United States Patent [19]

Asai

[11] Patent Number: 4,672,906

[45] Date of Patent: Jun. 16, 1987

[54] FREIGHT CARRIER'S HULL CONSTRUCTION FOR CARRYING CRYOGENIC OR HIGH TEMPERATURE FREIGHT

[75] Inventor: Koetsu Asai, Nagasaki, Japan

[73] Assignee: Mitsubishi Jukogyo Kabushiki Kaisha, Tokyo, Japan

[21] Appl. No.: 741,302

[22] Filed: Jun. 4, 1985

[30] Foreign Application Priority Data

| | | | |
|---|---|---|---|
| Jun. 8, 1984 | [JP] | Japan | 59-117685 |
| Jun. 8, 1984 | [JP] | Japan | 59-117686 |
| Jun. 11, 1984 | [JP] | Japan | 59-119623 |
| Jul. 16, 1984 | [JP] | Japan | 59-147250 |
| Jul. 18, 1984 | [JP] | Japan | 59-149141 |
| Nov. 28, 1984 | [JP] | Japan | 59-251404 |
| Dec. 13, 1984 | [JP] | Japan | 59-263684 |

[51] Int. Cl.[4] ..... B63B 25/16

[52] U.S. Cl. ..... 114/74 A; 220/901

[58] Field of Search ..... 114/74 R, 74 A; 220/901

[56] References Cited

U.S. PATENT DOCUMENTS

| | | | |
|---|---|---|---|
| 3,043,256 | 7/1962 | Corlett | 114/74 |
| 3,680,323 | 8/1972 | Bognaes et al. | 114/74 A |
| 3,828,709 | 8/1974 | Bognaes et al. | 114/74 A |
| 3,859,805 | 1/1975 | Johnson et al. | 114/74 A X |
| 3,882,809 | 5/1975 | Johnson et al. | 220/901 |

FOREIGN PATENT DOCUMENTS

| | | |
|---|---|---|
| 41-10227 | 6/1941 | Japan . |
| 47-9392 | 5/1972 | Japan . |
| 51-109684 | 9/1976 | Japan . |
| 54-13191 | 1/1979 | Japan . |

OTHER PUBLICATIONS

The Motor Ship, "The Methane Tanker, 'Jules Verne'", Oct. 1964, pp. 276–279.

*Primary Examiner*—Sherman D. Basinger

*Attorney, Agent, or Firm*—Wenderoth, Lind & Ponack

[57] ABSTRACT

An improved hull construction of a freight carrier with an upright cylindrical storage tank structure with heat-insulation on the outer circumferential surface thereof and having an upwardly-convex top surface, adaptable for the storage and transportation of high and/or low temperature freight material, which includes a tank bottom insulation disposed on the bottom part of the hull construction upon which the tank structure is mounted in position, tank skirt extending downwardly from the lower part of the cylindrical side plate extension of the tank structure, the upper part of the cylindrical tank skirt being secured to the tank structure, the lower part of the cylindrical skirt being connected to the hull construction, and wherein at least a peripheral part of the tank bottom plate is raised in height toward the peripheral edge and connected to the lower end of the tank side plate, while the upper end of the tank side plate is positioned over the upper deck surface of the vessel so that a substantial part of the tank protrudes over the said upper deck surface, and the diameter of the cylindrical storage tank is nearly equal to or greater than the height of the tank.

12 Claims, 21 Drawing Figures

FREIGHT CARRIER'S HULL CONSTRUCTION FOR CARRYING CRYOGENIC OR HIGH TEMPERATURE FREIGHT

BACKGROUND OF THE INVENTION

1. Field of the Invention

The present invention relates generally to an improvement in or relating to the freight carrier's construction, and more particularly to an improved hull construction of a freight carrier for the high temperature and/or cryogenic freight in the form of a cryogenic liquefied gas such as methane, ethylene, propane, butane, ammonium and the like, and in the form of a high temperature liquid or powder material such as coal/-heavy oil compound fuel, heavy oil, asphalt, sulfur, clinker, and the like.

2. Description of the Prior Art.

It is generally known that when loading such a high temperature or cryogenic freight material immediately into contact with the cargo room or storage structure incorporated in the hull of a freight carrier of, for instance, the dual shell construction, it is difficult technically to have such freight material insulated properly from the hull structure of a freight carrier, and that the hull structure is generally subjected to an excessive extent of thermal stress under the effect of a high or low temperature of the freight material while being stored therein. It has therefore been the practice, in the attempt to cope with such problem, to provide an additional insulated tank construction to the hull structure of a vessel in the inside thereof, into which the high or low temperature freight material is loaded and stored, accordingly.

While the tank or storage construction to be incorporated in the hull structure of a freight carrier is generally of the square type in practice, this type tank structure cannot be exempted from shortcomings such as the number of tank structural components being increased, the tank structure being voluminous and weighty, the working man-hours being greater, and the like.

On the other hand, while there has been proposed for use the tank structure of the spherical type, in the attempt to overcome such problems in the incorporated tank design as noted above, which is held by using the tank skirt extending along the equator line of the spherical shape thereof, it is generally known that this tank structure cannot be relieved from the such drawbacks as follows.

(1) An undesired small ratio of an interior volume of a tank versus a given volume allowable for the tank structure in the hull compartment area of a carrier, which would then result in an inferior volume efficiency.

(2) The combined weights of a freight material and a tank proper might generally be concentrated upon a tank skirt structure, which would undersirably result in a weighty tank construction in order to cope with the concentrated weight of the tank structure.

(3) Owing to the requirement in tank design that the upper end of a tank skirt structure exists along the equator line of the spherical configuration of a tank, the location of a tank skirt structure is necessarily relatively higher depending on a radius of the spherical tank configuration. In this connection, the tank skirt structure cannot generally be designed to be lowered in order to shorten the height of the tank skirt structure.

As the alternative of these square tank and the spherical tank, an upright cylindrical tank was proposed, and some vessels mounted with such cylindrical tanks have actually been constructed. However, those vessels mounted with the cylindrical tanks had the drawbacks as compared with those mounted with the spherical tanks as follows:

(1) The size of the hull for ensuring the same tank capacity failed to be reduced. In other words, as compared with the size of the hull, large tank capacity failed to be ensured.

(2) The surface area per volume of the tank becomes increased, and as a result, the conventional cylindrical tank system remains unprevailed.

In consideration of such drawbacks particular to the conventional tank structures of square or spherical types as well as conventional cylindrical type as noted above, it has long been a desire to attain an efficient resolution for overcoming such inevitable shortcomings in the design of a tank structure to be incorporated in the hull construction of a freight carrier with a limited space.

The present invention is essentially directed to the provision of a due and proper resolution to such inconveniencies and difficulties in practice as outlined above and experienced in the conventional tank structure designs of square and spherical types as well as conventional cylindrical type which have been left unattended with any proper countermeasures therefor.

SUMMARY OF THE INVENTION

It is therefore a primary object of the present invention to eliminate the above-noted drawbacks of the conventional vessels mounted with the tanks of square or spherical types as well as conventional cylindrical type, and to provide the vessels for transporting cryogenic or high-temperature freight material, which permit large-capacity tanks to be mounted, being of simple construction and completely satisfiable from the viewpoint of general arrangement of the vessel.

The above object of the invention can be attained efficiently from the improvement relating to the hull construction of a freight carrier with a cylindrical storage tank structure with heat-insulation on the outer circumferential surface thereof and having an upwardly-convex top surface, adaptable for the storage and transportation of the high and/or low temperature freight material, which comprises in combination, as summarized in brief, tank bottom insulating means disposed on the bottom part of the hull construction upon which the tank structure is mounted in position, tank skirt means extending downwardly from the lower part of the cylindrical side plate extension of the tank structure, the upper part of the cylindrical tank skirt means being secured to the tank structure, the lower part of the cylindrical skirt means being connected to the hull construction, and wherein at least a peripheral part of the tank bottom plate is gradually raised in height toward the peripheral edge and connected to the lower end of the tank side plate, while the upper end of the tank side plate is positioned over the upper deck surface of the vehicle so that a substantial part of the tank protrudes over the said upper deck surface, and the diameter of the said cylindrical storage tank is nearly equal to or greater than the height of the tank.

The principle, nature and details of the present invention, as well as advantages thereof, will become more apparent from the following detailed description by way of the preferred embodiments of the invention, when read in conjunction with the accompanying drawings, in which like parts are designated by like reference numerals.

DETAILED DESCRIPTION OF THE PREFERRED EMBODIMENTS

The present invention will now be described in detail by way of example but not by restriction in any way on preferred embodiments thereof in conjunction with the accompanying drawings, as follows.

Figure 1:
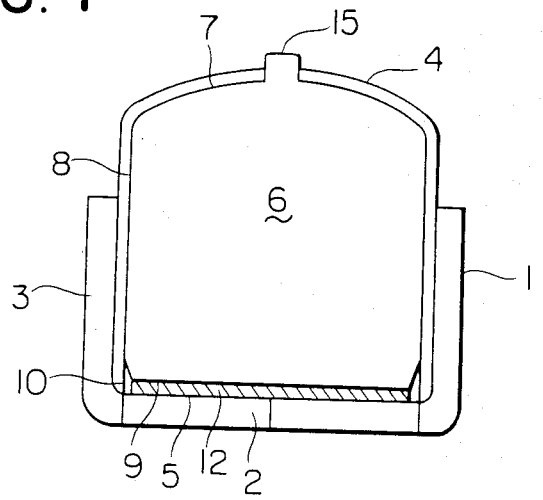
FIG. 1 is a schematic transverse cross-sectional view showing a preferred embodiment of the invention.
Figure 2:
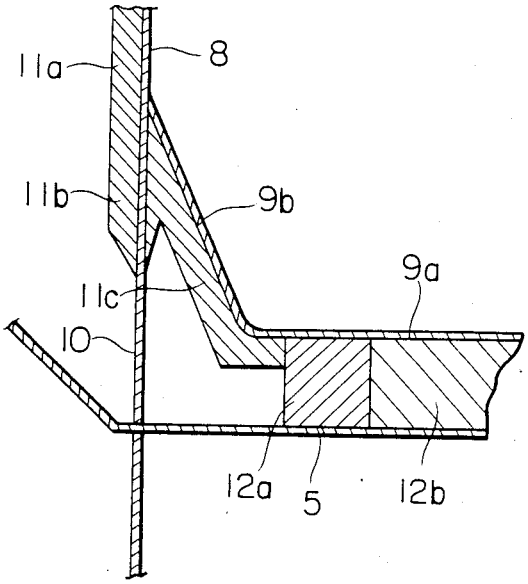
FIG. 2 is an enlarged fragmentary view showing, in transverse cross-section, the cylindrical skirt portion of the embodiment shown in FIG. 1.
Figure 3:
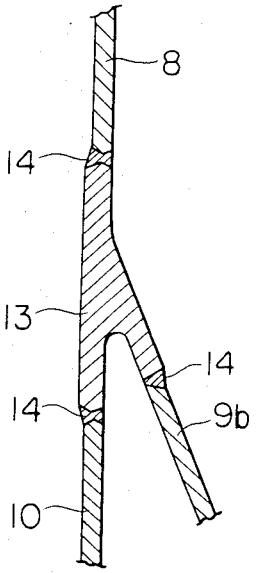
FIG. 3 is a fragmentary view showing the enlarged section of the junction between a tank's side plate and a cylindrical skirt portion.

Now, referring firstly to FIGS. 1 through 3, there is shown, by way of a preferred embodiment of the present invention, the general transversal profile of a hull construction of a freight carrier designated at the reference numeral 1, a dual-bottomed tank structure at 2 of the carrier's hull 1, a side tank structure at 3 of the hull 1, a tank cover at 4 of the hull 1, a double-shell top plate at 5 of the hull 1, the general configuraion of the transversal plane of a cylindrical tank at 6, a side plate at 8 of the cylindrical tank stucture 6, a bottom plate at 9 (comprised of elements 9*a* and 9*b*) of the cylindrical tank structure 6, a cylindrical skirt at 10, a heat insulating material or means at 11 (comprised of elements 11*a*, 11*b* and 11*c*), a tank bottom insulating material or means at 12 (comprised of elements 12*a* and 12*b*), a ring member at 13, a weld section at 14, and a tank dome designated at 15.

The general construction of the hull structure 1 according to this embodiment is shown such that the hull structure 1 comprises the double-bottomed tank 2, the broadwise side tanks 3 and the tank cover 4, with the cylindrical tank 6 installed in the space defined in the hull structure of the freight carrier. It is seen that the main structural portion of this cylindrical tank 6 is comprised of a tank top plate designated at 7 having an upwardly convex-shaped curved surface as viewed in FIG. 1, a tank side plate 8 of cylindrical shape and a tank bottom plate designated at 9 comprised of central flat portion 9*a* and steeply inclined peripheral portion 9*b* as viewed in FIG. 2, the cylindrical tank 6 being heat-insulated substantially throughtout its entire surface area by way of the heat insulating elements 11*a*, 11*b*, 11*c* and 12*a*, 12*b*.

It is also seen that there is provided a tank skirt portion 10 of a cylindrical shape extending downwardly from the bottom of the cylindrical tank side plate 8, with the upper end and lower end of the cylindrical skirt portion 10 being joined by way of welds with the tank side plate 8 and with the double-bottomed top plate 5 of the hull structure 1, respectively. The cylindrical tank 6 and the cylindrical skirt portion 10 are formed from a steel material for the cryogenic use, aluminum material or a steel material suitable for high-temperature applications, which are respectively suitable for use at temperatures used for storing liquefied petroleum gs or coal/heavy oil compound fuel, etc. The cylindrical skirt portion 10 is covered with heat-insulating elements 11*b* and 11*c* disposed only at its upper portion so that this portion may be maintained at a similar temperature to that of the cylindrical tank 6, while the lower portion thereof is left uncovered with the heat-insulating material for the use wherein it is held at a like temperature level as the ambient temperature around the cylindrical tank 6, with the middle areas between the upper and lower portions thereof having a gradual slope or gradient of temperature, accordingly.

With such an advantageous construction according to the present invention, when loading the liquefied petroleum gas, the coal/heavy oil compound fuel or the like into the cylindrical storage tank 6 of a freight carrier, this tank may extend or shrink owing to the high or low temperature of such freights, with the upper portion of the cylindrical skirt portion 10 being expanded or contracted in the like manner, respectively, thus affording substantial avoidance of the thermal stress problem in question. Since the problem of expansion and shrinkage or contraction of materials of the tank elements involved in the storage of such a high or low temperature freight is reverse in the physical nature of discussion, the following description will be limited to a discussion based on the nature of such tank elements when placed excusively under the cryogenic condition.

According to one preferred embodiment of the invention, it is further seen that the hull structure 1 of a freight carrier comprising the cylindrical tank 6 and the cylindrical skirt portion 10 is equipped with the tank bottom plate 9 and the double-bottom upper plate 5, both of which being disposed opposite to each other with an appropriate gap or space defined therebetween, in which space there is disposed a wooden packing element 12*a* formed from well dried wooden block which acts as a heat insulator or cushion and also as a tank weight supporter at a predetermined location in consideration of the specific double-shelled bottom construction of the storage tank, together with a heat insulator element of foamed polyurethane 12*b* disposed between the opposed wooden packing elements, the both wooden packing and polyurethane elements forming together a composite tank bottom heat-insulator 12 for the cylindrical tank 6. It is designed such that the majority of the freight's weight is supported by the double-bottom upper plate 5 through the tank bottom plate 9 and the tank bottom heat-insulator 12, accordingly. It is also designed such that part of the freight's weight, that is a body of freight existing near and around the tank side plate 8 is held by way of the cylindrical skirt portion 10 through the tank bottom plate 9.

In the case of the tank design such that the design pressure of the upper part of the cylindrical tank 6 is set to be higher than the pressure level of the ambient air around the tank 6, with the effect of causing the tank top plate 7 to be forced upwardly from the pressure difference existing across the inside and outside of the tank structure, it can be observed that the current weight rendered upon the cylindrical skirt portion 10 would then be made further smaller, or to be substantially zero.

During the cruising condition of a freight carrier where there may exist swinging or rolling motions resulting in a lateral factor of force, which would tend to cause the tank 6 to be played or shifted or turned over in the transverse direction, since the tank is held rigidly at its upper portion secured upon the tank structure and at its lower portion fixed to the cylindrical skirt portion 10 which is fixedly secured to the hull 1 through the double-bottom top plate 5, the tank may be held in position with a due stability in its location, accordingly, It is also designed such that the design height of the cylindrical skirt portion 10 is predetermined appropriately so that there may be a smooth and gradual slope or gradient of temperature between the upper and lower portions of the tank structure, a possible transfer of heat into the inside of the tank 6 through the cylindrical skirt portion 10 may be held to an allowable extent, and further that the double-bottom upper plate 5 may be well protected from being affected by the influence of the cryogenic state of the freight. Generally speaking, it is observed that the height of the cylindrical skirt portion 10 may tend to be made greater with the lower temperature of the freight.

While the gap defined between the central portion 9*a* of the tank bottom plate and the double-bottom top plate 5 is generally determined to be a smallest possible size in consideration of such conditions that there may be ensured a sufficient thickness of tank bottom insulating material required and that there may be allowed a sufficient space allowing access for the construction and inspection work, as the cylindrical skirt portion 10 according to this embodiment of the invention is designed to be higher than such smallest possible size of the gap, there is provided a steeply inclined peripheral portion 9*b* as typically shown in FIGS. 2 and 3, so that the upper portion of the cylindrical skirt portion 10 is joined at a substantial angle with the tank bottom central portion 9*a*.

With such a unique construction, it is possible in practice to design a storage tank with a relatively large volume without making the gap between the cylindrical tank 6 and the double-bottom top plate 5 excessively greater and without raising the center of gravity of the tank, even if it is essential to have the cylindrical skirt portion 10 higher in the design of the tank for such a further lower temperature freight as the liquefied natural gas.

On the other hand, there may be provided a man-hole or an access opening, not shown, in the cylindrical skirt portion 10 as necessary, so that the tank bottom plate 9 can be inspected from below, and there are further provided through openings for receiving the power lines for instrumentation, the pipings and the like, also not shown. There is also shown the tank dome at 15, which is not fixed rigidly upon the tank cover 4, but held air-tight therewith by aid of an appropriate flexible material. With this construction, the cylindrical tank 6 may thermally expand freely from the tank cover 4, accordingly.

FIG. 3 is an enlarged fragmentary view showing the junction point between the tank side plate 8, the tank bottom plate 9 and the cylindrical skirt portion 10 of a storage tank structure. In this construction, it is seen that a ring member 13 has a specific cross-sectional shape as shown in FIG. 3, which is designed with the same diameter as that of the cylindrical tank 6, and which is adapted to be joined with the lower end portion of the tank side plate 8, the upper end portion of the cylindrical skirt portion 10 and the tank bottom center member 9*b* by way of welds designated at 14, respectively, without any further complex members involved.

As shown in FIG. 1, the upper end of the tank side plate 8 is positioned over the upper deck surface of the hull 1, and the tank top plate 7 having an upwardly convex curved surface is connected to the upper end of the tank side plate 8, so that a substantial part of the tank protrudes over the upper deck surface of the hull 1.

The cylindrical tank according to the present invention is, due to the combined effects of the constructions of the upper and lower portions thereof, characterized in that the center of gravity of the tank is prevented from being unnecessarily raised, tank capacity per inboard volume of the vessel is large, and surface area per volume of the tank is small. These characteristics are for practical purposes most desirable for the tanks to be mounted on board the low-temperature liquefied gas carrier and the like.

Moreover, as clearly seen from the description and figures presented herein, the construction of the cylindrical tanks and supporting devices therefor according to the present invention are simple, light-weight and easy to assemble, and at the same time, the cylindrical skirt portion is of small-size and easily constructible, with the result that the features expected for the upright cylindrical tanks are exhaustively realized to the optimum extent by the present invention.

Now, according to this embodiment shown, while the diameter and the height of the cylindrical tank 6 seem to be generally equal in length, it is the practice in the design of a vessel specialized for the particular services as noted above that the tank height would be designed to be in the range from 0.7 to 1.2 times the diameter of a tank.

As fully reviewed on the specific embodiment of the invention by way of FIGS. 1 through 3, it is to be noted that the present invention may bring the following advantageous effect and function; that is, (1) The tank capacity per inboard volume of the vessel is substantially increased. That is, volume efficiency is remarkably improved.

(2) The surface area per volume of the tank is substantially decreased. This means that if the total tank capacity is constant, the tank insulating area is decreased and insulating performance is enhanced.

(3) The tanks and the cylindrical skirts are of simple construction, light-weight, and can be easily assembled.

(4) For such reasons, the performance of the vessel is remarkably improved, and the construction cost is substantially reduced.

Figure 4:
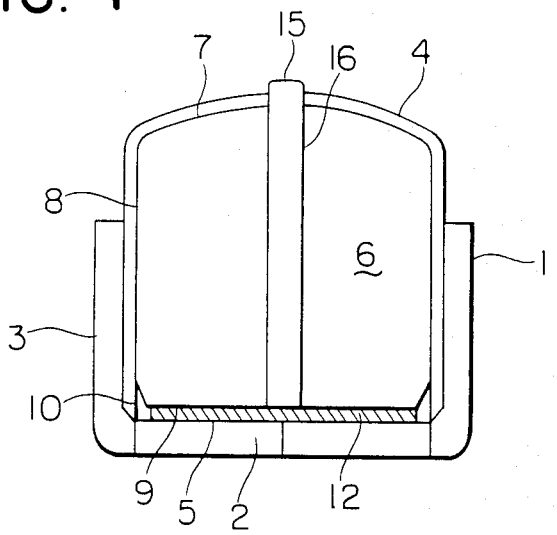
FIG. 4 is a schematic transverse cross-sectional view showing the general construction of another embodiment of the invention.

It is seen in FIG. 4 that there is shown another embodiment of the present invention, which comprises in addition a cylindrical tower structure designated at 16. The construction of the tower structure 16 is such that its lower portion is mounted rigidly upon the tank bottom plate 9 and its upper portion is fixed in position of the tank top plate 7 respectively by way of welds. Also, there are provided such elements as pipings, power lines, a ladder structure and the like, not shown, in the inside of the tower structure 16, and also an opening not shown either for an intercommunication of gases between the inside of the tower structure 16 and the cylindrical tank 6.

In this drawing figure, the like parts as those of the former embodiment are designated at like reference numerals.

Figure 5:
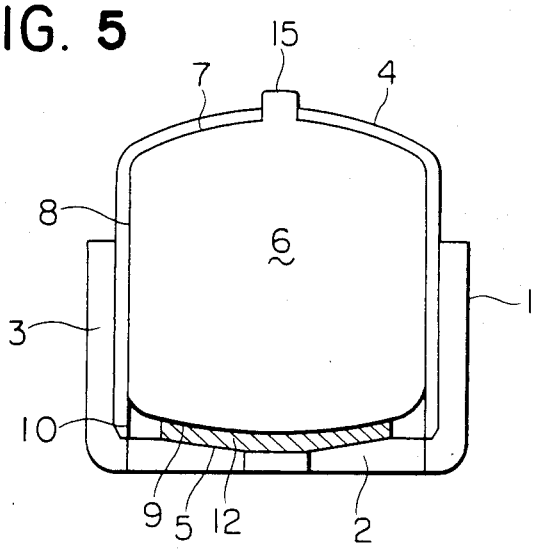
FIG. 5 is a similar schematic transverse cross-sectional view showing a further embodiment of the invention.
Figure 6:
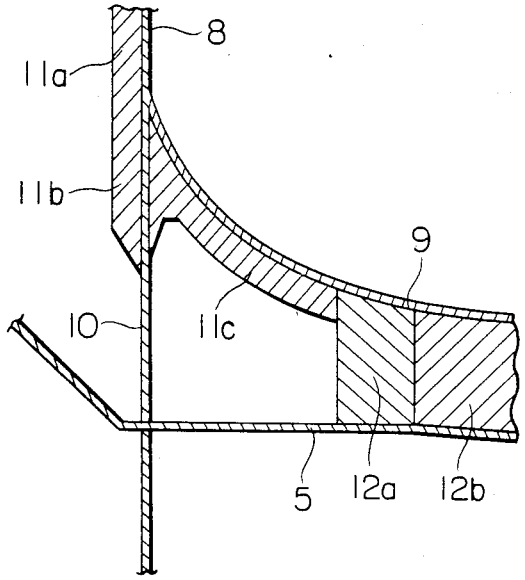
FIG. 6 is an enlarged fragmentary view showing, in transverse cross-section, the cylindrical skirt portion of the embodiment shown in FIG. 5.
Figure 7:
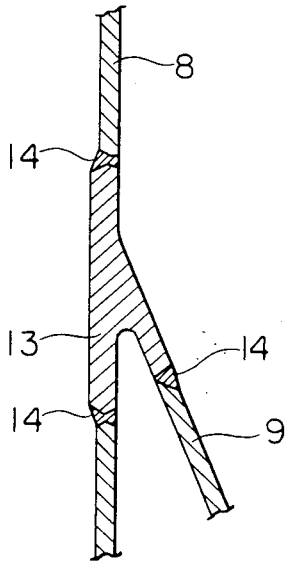
FIG. 7 is a fragmentary sectional view similar to FIG. 3 showing the enlarged section of the junction between a tank's side plate and a cylindrical skirt portion.

FIGS. 5 through 7 show a further embodiment of the invention, in which the tank bottom plate 9 comprises a curved plate member with its central portion having a lowest height. While the gap defined between the tank bottom center plate 9 and the double-bottom upper plate 5 is generally determined to be a smallest possible size in consideration of such conditions that there may be ensured a sufficient thickness of tank bottom insulating material required and that there may be allowed a sufficient space allowing the access for the construction and inspection tasks, as the cylindrical skirt portion 10 according to this embodiment of the invention is designed to be higher than such smallest possible size of the gap, there is provided a tank bottom plate 9 having such a specific sectional configuration that its central portion is generally concave with a curvature rising up to and merging with the upper portion of the cylindrical skirt portion 10 at its peripheral edge.

With such a construction, it is possible in practice to design a storage tank with a relatively large volume without making excessively greater the gap between the cylindrical tank 6 and the double-bottom upper plate 5 and with the center of gravity of the tank being prevented from being raised, even if it is essential to have the cylindrical skirt portion 10 higher or longer in the design of the tank for such a further lower temperature freight as the liquefied natural gas.

FIG. 7 is an enlarged fragmentary view showing the junction point between the tank side plate 8, the tank bottom plate 9 and the cylindrical skirt portion 10 of a storage tank structure. In this construction, it is seen that a ring member 13 has a specific cross-sectional shape as shown in FIG. 7, which is designed with the same diameter as that of the cylindrical tank 6, and which is adapted to be joined with the lower end portion of the tank side plate 8, the upper end portion of the cylindrical skirt portion 10 and the tank bottom center member 9 by way of welds designated at 14, respectively, without any further complex members involved.

Now, according to this embodiment shown, while the diameter and the height of the cylindrical tank 6 seem to be generally equal in length, it is the practice in the design of a vessel specialized for such services as noted above that the tank height would preferably be designed to be in the range from 0.7 to 1.2 times the diameter of a tank.

In this drawing figure, the like parts as those of the former embodiment are designated at like reference numerals.

Figure 8:
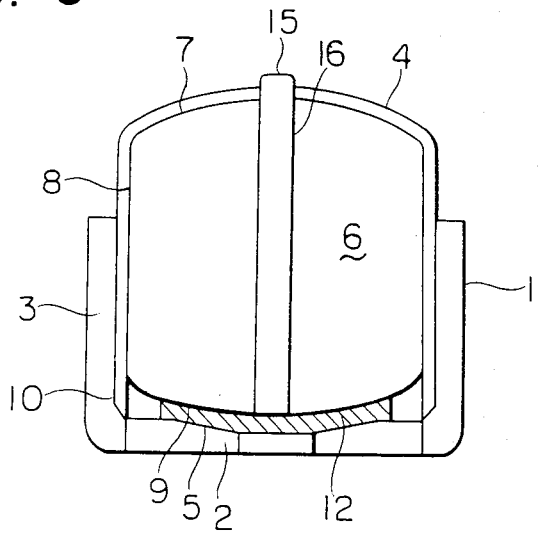
FIG. 8 is a schematic transverse cross-sectional view showing the general construction of a still further embodiment of the invention.

FIG. 8 is a schematic sectional view similar to FIG. 5, in which it is seen that there is shown a still further embodiment of the present invention, which comprises a cylindrical tower structure designated at 16 having the lower portion thereof mounted rigidly upon the tank bottom plate 9 and the upper portion thereof fixed in position to the tank top plate 7 respectively by way of welds. Also, there are incorporated such elements as pipings, power lines, a ladder structure and the like, not shown, in the inside of the tower structure 16, and also an opening also not shown allowing an intercommunication of gases between the inside of the tower structure 16 and the cylindrical tank 6.

Figure 9:
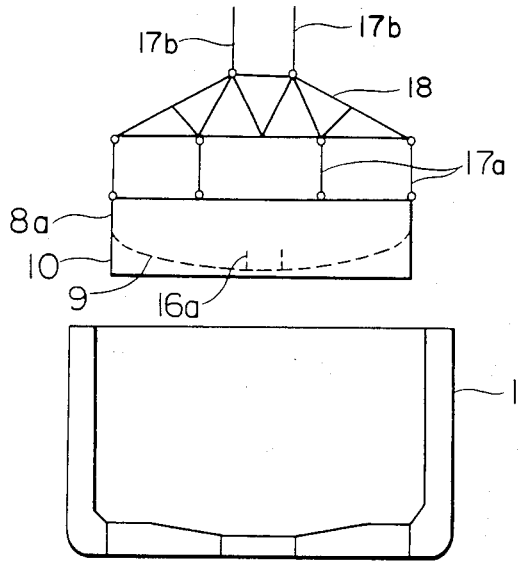
FIG. 9 is a schematic view showing the state of installation of a still further embodiment of the invention.

FIG. 9 is a schematic view showing the state of installation of tank structure according to a still further embodiment of the invention, in which there is shown the lower block of the cylindrical tank 6 under the step of installation. In this drawing figure, the hull structure 1 is shown in transversal section, and the general transversal section of the freight carrier when completed with the tank structure is as shown in FIG. 8.

In connection with the tank structure, it is noted that the tank bottom plate 9 is designed with the mechanical strength such that its configuration may be maintained safely without any structural support of the tank bottom insulating material when there is stored no freight in the cylindrical tank 6.

FIG. 9 shows the condition that the major structural block comprising part of the tank side plate **8*a* and the lower portion 16*a* of the tower structure provided in addition to the cylindrical skirt portion 10 and the tank bottom plate 9 in the tank structure is being installed into the hull structure 1 of a freight carrier. There are shown a series of hanging wires 17*a*, 17*b* and a truss structure 18 for holding-up the tank block. This major block may be assembled at a different assembly site and such a manner of lifting and installation of the tank block may now be employed as typically shown in FIG. 9 by using a heavy-duty crane not shown, by virtue of the advantageous structure of an appropriate overall strength of the tank bottom plate 9**.

As a consequence, it is possible in practice to have the tank structure in the form of semi-assembled major block, which is assembled on an appropriate construction site which is adaptable immediately to the installation into the freight carrier's hull, as the tank bottom plate is designed with the mechanical strength such that its configuration may be maintained safely without any structural support of the tank bottom insulating material, when no freight is stored in the cylindrical tank 6.

In this drawing figure, the like parts as those of the former embodiment are designated at like reference numerals.

FIGS. 10 through 13 are schematic views showing a preferred embodiment of the invention which is directed to the resolution of the shortcomings particular to the conventional liquefied gas carrier equipped with a square or spherical tank as well as a conventional cylindrical tank as noted above. In this drawing, there are shown the general configuration of a freight carrier at 21, a carrier's engine room 22, a front cofferdam 23, a rear cofferdam 24, a double-bottom tank 25, a partition wall 26 (26*a*, 26*b*, 26*c*), a tank cover 27, an upper deck 28, an aft-peak tank 29, a fore-peak tank 30, a cylindrical tank shown generally at 31 (comprising 31*a*, 31*b*, 31*c*, 31*d*), a top plate 32 of the cylindrical tank 31, a side plate 33 of the cylindrical tank 31, a bottom plate 34 of the cylindrical tank 31, a cylindrical skirt portion 35, a double-shelled upper plate 36 of a carrier, a heat-insulating material 37 (comprising 37*a*, 37*b*, 37*c*, 37*d*), a tank bottom insulator 38 (38*a*, 38*b*, 38*c*), a tank dome 39, a side tank 40, and a girder 41 in the inside of the double-shelled bottom structure, respectively. There may also be provided a reliquefying unit not shown in the center or any other suitable position of the series of tanks in the freight carrier.

Also, there are provided a series of freight tanks disposed in the tank zone extending intermediate the front cofferdam 23 and the rear cofferdam 24.

There are provided four tanks zones in total extending along the longitudinal axis of the freight carrier and separated by way of partitions 26*a*, 26*b*, 26*c*, in which there are installed four cylindrical tanks 31*a*, 31*b*, 31*c*, 31*d*, one for each of these four tank zones. Also, there is provided a side tank 40 along the broadside of the tank zone in the carrier, thus providing the dual-shell structure extending along the broadside of the carrier, as typically shown in FIG. 12. A tank cover 27 is seen provided atop the tank structure, which tank cover is fixed securely in position of the upper deck 28. The cylindrical tanks 31*a* and 31*d* which are respectively disposed on the foremost or bow and the tail or stern side of the carrier are formed specifically in such a manner that they follow the tapered configurations at the bow and stern positions of the carrier so that they may be nested snugly according to the thinning or narrowing shapes of these hull portions. The two middle cylindrical tanks 31*b* and 31*c* are designed to be the same shape as shown in FIG. 12.

Figure 12:
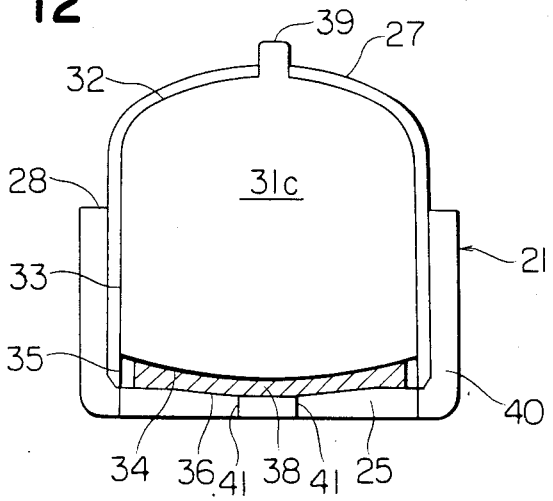
FIG. 12 is a cross-sectional view taken along the line XII—XII in FIGS. 10 and 11.

Now, referring more specifically to the tank configuration according to the embodiment shown in FIG. 12, the ratio of the diameter of a circle as appeared when cut in the horizontal plane of the cylindrical tank (identical with the tank's width as shown in the drawing figure) versus the vessel's width is approximately 80%, the height of the tank complete excluding a tank dome 39 is generally the same as the tank width, the height of a cylindrical side plate 33 of the tank is about 60% of the height of the tank complete, with the upper part of the tank complete appeared rising by approximately 40% thereof above the surface of the upper deck.

Figure 13:
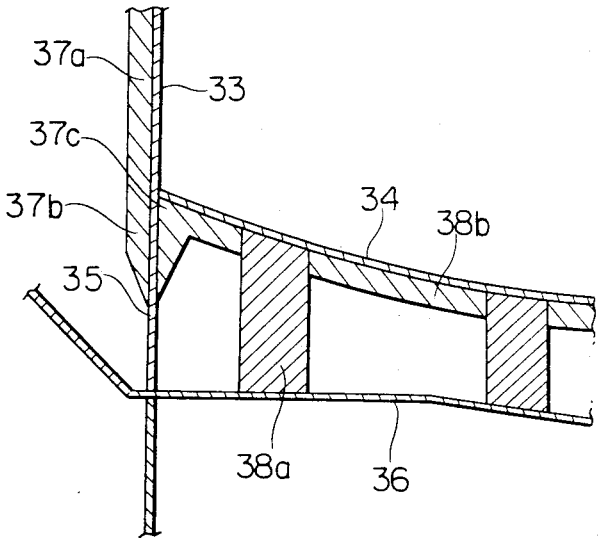
FIG. 13 is an enlarged fragmentary view showing the cylindrical tank skirt portion.

The cylindrical tank 31*c* comprises, as its main structural elements, a tank top plate 32 having an upwardly-convex surface, a tank side plate 33 of cylindrical shape and a tank bottom plate 34 having an downwardly-convex surface, and is covered substantially totally with insulating material 37, 38. There is also provided a cylindrical skirt portion 35 extending downwardly from the lower end of the cylindrical tank side plate 33, with the upper portion of the cylindrical skirt portion 35 being fixed securely to the tank side plate 33 and with the lower portion fixed to the double-shelled upper plate 36 of the carrier's hull 21. While the cylindrical skirt portion 35 is omitted from FIG. 10, this is shown in FIGS. 12 and 13, respectively. The cylindrical tank 31 and the cylindrical skirt portion 35 may be formed from a low-temperature steel or aluminum sheet which is adaptable to the storage of liquefied gas freight.

As shown in FIG. 13, the cylindrical skirt portion 35 is provided with the insulating material 37*b*, 37*c* at its upper portion only so that this portion may be held generally as high as the temperature of the cylindrical tank 31, while the lower portion thereof is left uncovered with the heat-insulating material for the use wherein it is held at a like temperature level as the ambient temperature around the cylindrical tank 31, with the middle areas existing between the upper and lower portions thereof having a gradual slope or gradient of temperature, accordingly. With such an advantageous construction according to the present invention, when loading the liquefied petroleum gas into the cylindrical storage tank 31 of a freight carrier, this tank may shrink due to the low temperature of such freight, with the upper portion of the cylindrical skirt portion 35 being contracted therewith, thus affording an efficient avoidance of the thermal stress problem in question, as stated hereinbefore. Between the tank bottom plate 34 and the double-bottom upper plate 36, there is defined an appropriate gap or space, in which space there is disposed a wooden packing element 38*a* formed from well dried wooden block as a heat insulator and also as a tank weight supporter for the storage tank, together with a heat insulator element of foamed polyurethane 38*b* disposed between the opposed wooden packing elements, the wooden packing and polyurethane elements 38*a*, 38*b* forming together a composite tank bottom heat-insulator 38 for the entire cylindrical tank 31.

It is designed that the majority of the tank's weight and the freight's weight is supported by the double-bottom upper plate 36 through the tank bottom plate 34 and the tank bottom heat-insulator 38, and remaining part is held by way of the double-bottom upper plate through the cylindrical skirt portion 35.

While in a condition of a freight carrier where there may exist swinging or rolling motions resulting in a lateral factor of force, which would tend to cause the tank 31 to be played or shifted or turned over in the transverse direction, since the tank is held rigidly at its upper portion secured upon the tank structure and at its lower portion fixed to the cylindrical skirt portion 35 which is fixedly secured to the hull 21 through the double-bottom top plate 36, the tank may be held in position with a due stability in its location, accordingly.

Figure 10:
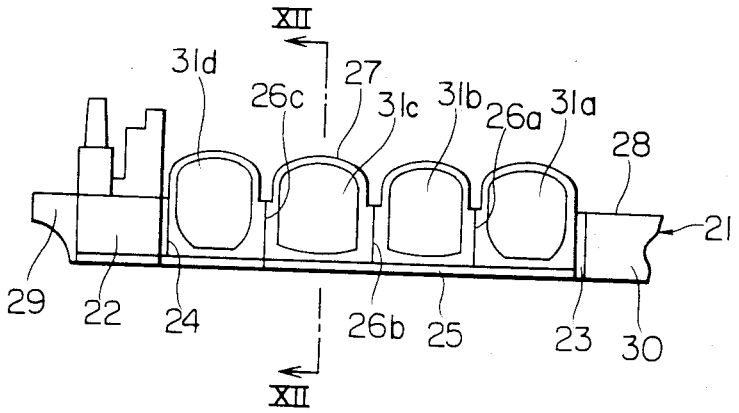
FIG. 10 is a longitudinal cross-sectional view of the vessel showing an embodiment of the invention.
Figure 11:
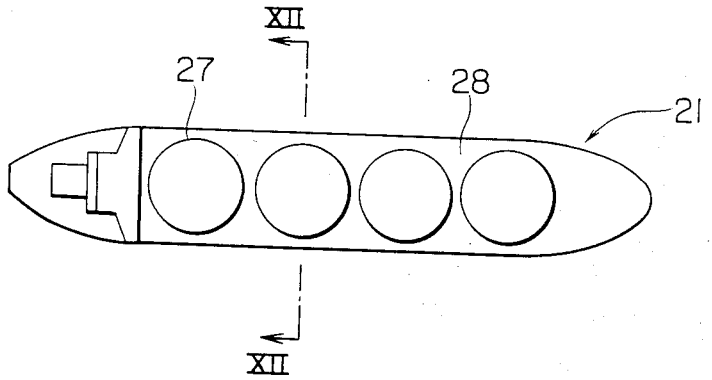
FIG. 11 is a top plan view of the embodiment shown in FIG. 10.

In the present embodiment of the invention as shown typically in FIGS. 10 and 11, the storage tank structure has its structural feature that there are arranged four cylindrical tanks 31 along the longitudinal axis of a freight carrier, whereby this arrangement is specifically advantageous from the design of the overall vessel's style and from the determination of the arrangement of many components involved.

According to the present embodiment shown in FIGS. 10 and 11, it is seen that the overall length of a freight carrier (referred hereinafter to as "the length between perpendiculars") is approximately five times the vessel's overall width, which is of the economical dimensioning on the basis of the so-called "short-and-thick" style, and in which there are adopted four cylindrical tanks 31 having a relatively large capacity with respect to the vessel's width, it is advantageous that there can be provided the aft-peak tank 29, the engine room 22, the front and rear cofferdams 23, 24, the ample cylindrical tank installation areas and the fore-peak tank 30 arranged in reserve along the longitudinal axis of the vessel, despite the relatively short length between perpendiculars of the vessel.

With respect to the fundamental question of design of a vessel under the full load condition, it is essential to have the lengthwise positions of the center of gravity including the weight of freight and the center of buoyancy of a vessel coincided with each other for the attainment of substantial zero trimming in the vessel's operation. As there is a substantial reserve in the general arrangement of equipment along the longitudinal axis of the vessel, or the liquefied gas carrier according to the present invention, there is made available a substantial range of setting of the center of gravity of a freight carrier under the payload of freight. In this respect, therefore, it is now possible in practice of the lines drawing to put an advantage in the design of vessel's resistance and propulsion performances over the stability performance, thus affording a substantial improvement in the eventual performance of a vessel, accordingly.

Figure 14:
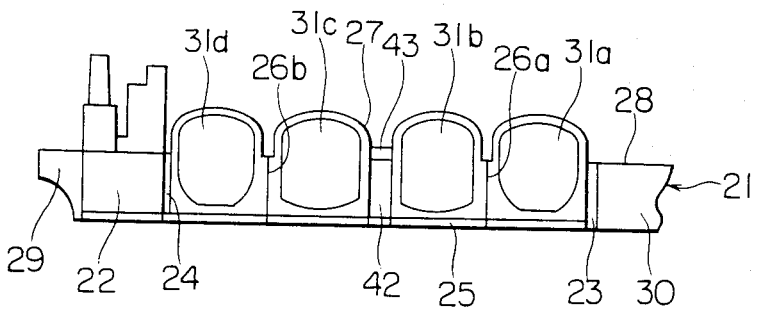
FIG. 14 is a longitudinal cross-sectional view of the vessel similar to FIG. 10 showing a still further embodiment of the invention.
Figure 15:
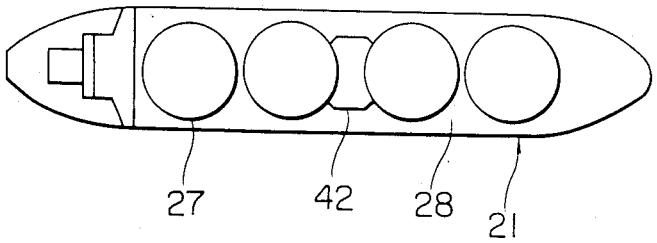
FIG. 15 is a top plan view similar to FIG. 11 of the embodiment shown in FIG. 14.

Now, referring to FIGS. 14 and 15 showing a still further embodiment of the present invention, there are seen provided a deep tank 42 and a reliquefying unit 43 near the central position along the longitudinal axis of a vessel's hull 21.

In this drawing figure, the like parts as those of the former embodiment are designated at like reference numerals.

It is known to those skilled in the art that the central deep tank 42 may be adapted to serve a due quantity of ballast when used as a ballast tank, while contributing to the reduction in the sagging moment with a full payload, and it may also contribute to the reduction in the hogging moment when used in ballast operation, thus eventually making it feasible to curtail the longitudinal strength of a vessel, accordingly.

Now, referring more specifically to the embodiment shown in FIGS. 14 and 15, it is noted that the length between perpendiculars of the vessel is approximately five times the vessel's width, which is of the so-called short and thick type bringing the economically advantageous aspect ratio, in which is is feasible in practice to adopt four cylindrical tanks having a relatively large capacity with respect to the vessel's width, it is advantageous that there can be provided the aft-peak tank 29, the engine room 22, the front and rear cofferdams 23, 24, the ample cylindrical tank installation areas and the fore-peak tank 30 arranged in reserve along the longitudinal axis of the vessel, despite the relatively short length between perpendiculars of the vessel, and in addition that there can be employed the central tank, accordingly.

Next, here is shown a preferred embodiment of the invention on a practical design basis.

This is of the general arrangement as shown in FIGS. 14 and 15, with the such exemplary dimension of a liquefied gas carrier having the tank capacity of 82,000 $m^3$, the length between the perpendiculars of 200.00 m, the width of 40.00 m, and the depth of 21.00 m.

In this example, it is seen that the tank capacity is relatively large, wherein it may exhibit such an advantageous volume efficiency, as expressed in terms of (a freight tank volume/a vessel's length between perpendiculars X width X depth), as large as 0.488, which is a value that could never be attained from the practices of the square tank type, spherical tank type or of the conventional cylindrical tank type, at all.

While it is obvious at a glance that the total surface area of the tanks would be smaller than those of the square tank type or the conventional cylindrical tank type, it is to be noted that the total area of the tank as adapted to the case of 82,000 $m^2$ by way of the preferred embodiment of the present invention may eventually turn out to be approximately 2% smaller than the five spherical tank arrangement that enjoys the world's largest manufacturing record.

Figure 16:
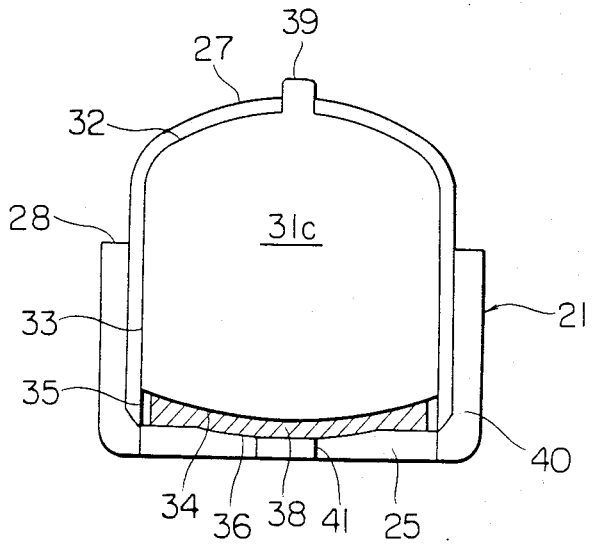
FIG. 16 is a schematic view showing, in transverse cross-section, the general state that the liquefied-gas storage tank structure according to the invention is installed in position of a liquefied gas carrier.

FIG. 16 is a schematic cross-sectional view showing a preferred embodiment of a liquefied gas tank according to the invention in which the drawbacks particular to the conventional upright-type cylindrical liquefied gas tank have been eliminated, and which is adaptable to the carrier for the cryogenic liquefied gases as typically shown in FIG. 14. Referring more specifically, it is designed that the ratio of the diameter of a circle as appeared when cut in the horizontal plane of the cylindrical (identical with the tank's width as shown in the drawing figure) versus the vessel's width is approximately 80%, the height of the tank complete excluding a tank dome 39 is generally the same as the tank width, the height of a cylindrical side panel 33 of the tank is about 60% of the height of the tank complete, with the upper part of the tank complete appeared rising by approximately 40% thereof above the surface of the upper deck.

While it is the common practice to design the tank height to be generally equal to the tank width in order to attain a good balance of the entire arrangement, it is natural to take a choice accordingly to the current circumstances in the actual design of an individual tank structure, as the case may be. In this connection, there is inevitable such a disadvantage that the tank capacity be reduced considerably when its height is substantially decreased with respect to its width, and there would be such inconveniences as the poor stability of a vessel accompanying a poor visibility from the steering bridge when its height is designed to be too high, respectively.

The cylindrical tank 31*c* comprises, as its main structural elements, a tank top plate 32 having an upwardly-convex surface, a tank side plate 33 of cylindrical shape and a tank bottom plate 34 having a downwardly-convex surface, and these plates are not equipped with any substantial stiffener arrangement. Also, the tank 31*c* is covered substantially totally with insulating material as in the embodiment shown in FIG. 13. There is also provided a cylindrical skirt portion 35 extending downwardly from the lower end of the cylindrical tank side plate 33, with the upper portion of the cylindrical skirt portion 35 being fixed securely to the tank side plate 33 and with the lower portion fixed to the double-bottom top plate 36 of the carrier's hull 21. As the general construction of the cylindrical skirt portion 35 and its function arrangement is substantially identical with those shown in FIG. 13, no further description is made.

Figure 17:
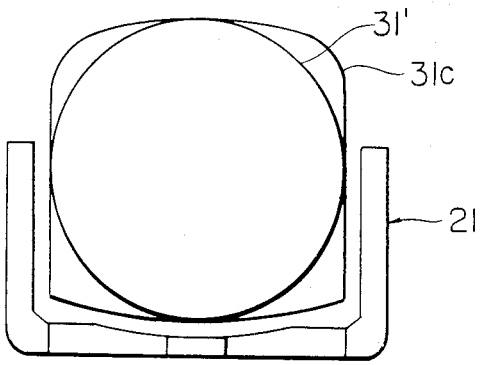
FIG. 17 is a schematic view showing in comparison a tank by way of one typical embodiment of the invention and a conventional spherical tank.

Now, the schematic view shown in FIG. 17 is for the illustration in comparison of the improved cylindrical tank according to the present invention with the spherical tank arrangement.

Referring to FIG. 17, there are shown an exemplary cylindrical tank 31*c* of the invention and a spherical tank 31' overlapped one upon another, in which the widths and heights of the both tanks are identical, and the cylindrical tank 31*c* is of a configuration that circumscribes the circular shape of the spherical tank 31'. This cylindrical tank 31*c* exhibits its volume which is approximately 1.33 greater than that of the spherical tank, which evidences the improvement in volume efficiency of the present invention over the conventional one.

Moreover, it is to be noted that the surface are of this cylindrical tank 31*c* may turn out to be approximately 1.30 times that of the spherical tank 31', while the surface area per unit volume of the former is approximately 0.98 times that of the latter, which would then evidence the advantage in its heat-insulation property.

FIGS. 18 through 21 show still further embodiments of the invention, wherein there are provided four compartments arranged serially along the longitudinal axis of the vessel, like in the embodiment shown in FIG. 14, in each of which there is seen installed one of cylindrical tank structures 71*a*, 71*b*, 71*c* and 71*d*, respectively.

Figure 18:
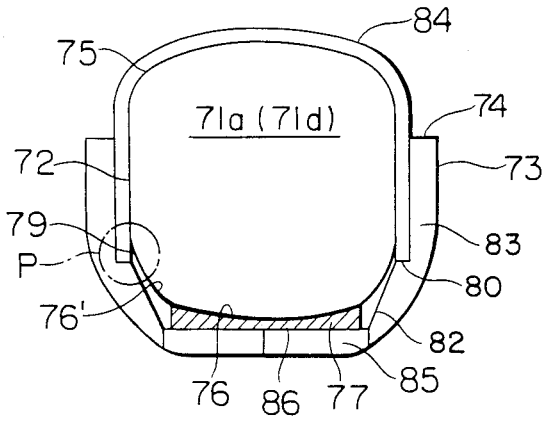
FIGS. 18–20 are schematic views showing, in transverse cross-section, further embodiments of the invention.
Figure 19:
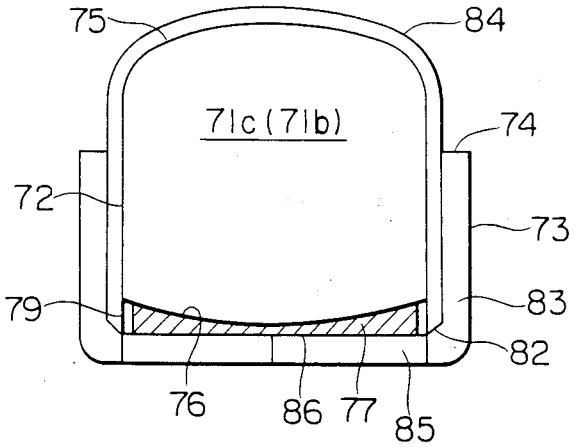

Referring more specifically to the configuration of these tank structures 71*a* through 71*d* by way of FIGS. 18 and 19, it is designed that the ratio of the diameter of a circle as appeared when cut in the horizontal plane of the cylindrical tank (identical with the tank's width as shown in the drawing figure) versus the vessel's width is approximately 80%, the height of the tank complete is generally the same as the diameter of the cylindrical tank, the height of a cylindrical side panel 72 of the tank is about 60% of the height of the tank complete, with the upper part of the tank complete appeared rising by approximately 40% thereof above the surface of the upper deck 74, which can then bring such an overall appearance that approximately 40% of the height of the tank complete would be seen projecting above the upper deck 74 of the vessel's hull structure 73, accordingly.

The cylindrical tank structures 71*a* and 71*d* as installed in the bow or stern portion of a vessel comprise as its main structural elements as shown in FIG. 18 a tank top plate 75 having an upwardly-convex surface, a side panel 72, a bottom plate 76 having a downwardly-convex surface, and tank bottom's inclined side plates 76' connecting the side panel 72 and the bottom plate 76, and these plates are not provided with any substantial stiffener material at all.

Now, referring to the configuration of the bow and stern portions of a vessel, it is noted that the vessel's width becomes substantially smaller at each end than in the middle portion of the hull, and this configurational aspect appears particularly towards the bottom portion in terms of the width compared with the level at the upper deck 74. In this respect, it is essential to design the configuration of these tank structures following the specific changes in cross-section such that the area of the bottom plate 76 of the tank 71*a* (or 71*d*) which comes into contact with the tank weight support 77 serving also as the heat-insulator be substantially smaller than that of the cylinder of the tank 71*a* (or 71*d*) as appeared when cut in the horizontal plane, accordingly.

Figure 21:
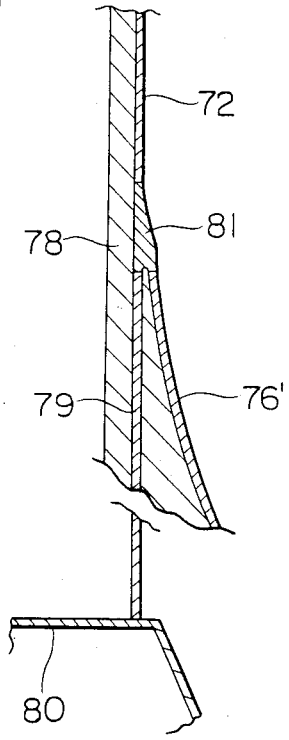
FIG. 21 is an enlarged fragmentary view showing the part B shown in FIG. 18.

As seen in FIG. 21, there is provided a heat-insulating material 78 around the outer circumference of the tank 71*a* (or 71*d*), with which material the entire area of the tank may be substantially heat-insulated.

On the other hand, it is seen that the upper end of a cylindrical skirt 79 is connected to the lower end of the side panel 72 of the cylindrical tank 71*a* (or 71*d*), and the lower end of this cylindrical skirt 79 is connected to a cylindrical skirt mount 80 on the vessel's hull 73. In this construction, the position of junction between the lower end of the cylindrical skirt 79 and the cylindrical skirt mount 80 is placed higher than the position where the bottom plate 76 of the tank 71*a* (or 71*d*) rests upon the vessel's hull 73.

Also, it is seen that the upper end of the cylindrical skirt 79 and the lower end of the side panel 72 of the tank 71*a* (or 71*d*) are connected together by way of a connection ring member 81, and are also connected to the tank inclined plate 76' through the connection ring member 81, respectively.

Now, referring further to the tank weight support member 77, there are provided wooden blocks for the combined heat-insulating and weight supporting purposes, with the tank weight support member 77 in discrete relationship over the whole area under the bottom 76 of the cylindrical tanks 71*a* through 71*d*, these wooden blocks being mounted in position on a steel frame, not shown.

Also, this tank weight supporting member 77 may be designed in a variety of constructions according to given conditions, for instance, it is one of the measures to install a formed panel of hard foamed polyurethane which exhibits a substantial weight resisting performance over the extended area in position under the bottom plate 76.

According to the construction of the cylindrical tank 71*a* (or 71*d*) shown in FIG. 18, it is designed such that the area of the bottom plate 76 can be approximately 50% of that of the cylinder as appeared when cut along the horizontal plane, approximately 50% of the weight of freight stored in the tank 71*a* (or 71*d*) may be supported by the tank weight support member 77, and approximately 50% thereof held by the cylindrical skirt 79.

This cylindrical skirt 79 also serves as a substantial stay structure which may hold the cylindrical tank 71*a* (or 71*d*) from the lateral motions and tumbling motions which result from the swinging motions of the vessel's hull 73.

Incidentally, while the cylindrical tanks 71*b*, 71*c* mounted in the middle position of the vessel's hull are constructed generally in the same manner as the cylindrical tank 71*a* (or 71*d*) as shown in FIG. 19, they have no inclined side plates 76' equipped on their bottom, but the side panel 72 and the bottom plate 76 are directly connected. This is because the vessel'widths are found generally constant at any levels in the middle position of the vessel, and because this particular construction may serve accordingly to suit the cross-sectional shapes of the vessel and utilize more efficiently the given spaces inside the vessel's hull structure.

For this reason, the area of contact of the bottom plate 76 of the cylindrical tank 71*c* (or 71*b*) resting upon the tank weight support member 77 is generally equal to that of the cylinder as appeared when cut in the horizontal plane of the tank 71*c* (or 71*b*).

Also, it is designed such that the position of the junction between the lower end of the cylindrical skirt 79 and the vessel's hull structure 73 is disposed substantially lower than the position where the bottom 76 of the cylindrical tank 71*b* (or 71*c*) is supported.

Figure 20:
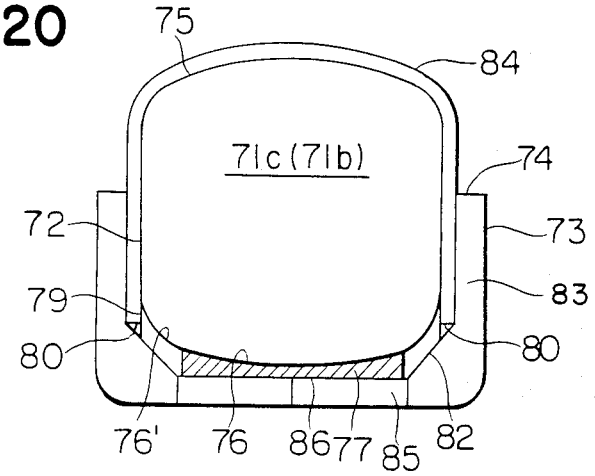

Furthermore, the cylindrical tank 71*b* (or 71*c*) to be installed in the middle position of the vessel's hull may, as shown in FIG. 20, be designed with the lateral inclined plates 76' like in the tank 71*a* (or 71*d*). In this case, as the area of the tank bottom plate 76 opposing the tank weight support member 77 is relatively small and the position of the cylindrical skirt 79 with respect to the vessel's hull structure 73 is relatively high, there is attained such advantages that a double-bottom hooper 82 for the hull structure 73 may be designed to be substantially greater in the area near the cylindrical tank 71*b* (or 71*c*) mounted in the middle of the vessel, and the lateral span of the double-bottomed structure may be reduced accordingly, and also that the entire bottom construction of the vessel's hull structure 73 may be designed with a substantially increased strength.

According to the construction of the invention noted hereinbefore, four cylindrical tanks 71*a* through 71*d* can be mounted in serial fashion along the longitudinal axis of the vessel, whereby it is now feasible in practice to materialize the reasonable style decision of a vessel and the optimal arrangement of equipment in connection with the design of a cylindrical tank-loaded vessel, accordingly.

Also, according to this advantageous hull structure of a cylindrical tank-loaded vessel of the invention, the heat-insulated tank structures may equally be installed not only in the middle position but also in the leading and trailing positions of a vessel having a strict width restriction, thereby affording a maximum and optimal serviceability in the transportation of liquefied gases and the like freights.

In addition, it can be designed such that the diameter of each cylinder as appeared when cut in the horizontal plane of the cylindrical tank structure be equal to or greater than one half of a given lateral width of the vessel, and the height of such a tank can be made generally equal to the diameter of the cylinder, with its upper part projecting substantially above the plane of the upper deck, whereby a relatively large capacity of a tank versus the given dimensions of a vessel can be attained, accordingly.

In the drawing, there are shown side ballast tanks designated at 83, a tank cover at 84, a double-bottomed tank at 85 and a double-shelled upper plate at 86, respectively.

While the present invention has been described fully hereinbefore by way of the typical preferred embodiments thereof, it is to be understood that the present invention is not intended to be restricted to the details of the specific constructions as shown in the preferred embodiments thereof, but to the contrary, many changes and modifications may be made in the foregoing teachings free from any restrictions thereto and without departing from the spirit and scope of the invention.

It is also to be understood that the appended claims are intended to cover all of such generic and specific features particular to the invention as disclosed herein and all statements relating to the scope of the invention as a matter of language may accordingly be said to fall thereunder.

I claim:

1. A hull construction of a freight carrying vessel including at least one upright cylindrical storage tank structure with heat-insulation on the outer circumferential surface thereof and having a cylindrical tank bottom plate at a lower end thereof and an upwardly-convex top surface extending from a cylindrical side plate thereof, adapted for storage and transportation of high and/or low temperature freight material, which comprises in combination:

tank bottom insulation means disposed on the bottom part of said hull construction upon which said cylindrical storage tank structure is mounted in position;

tank skirt means extending downwardly from a lower portion of said cylindrical side plate of said cylindrical storage tank structure, said tank skirt means secured at an upper end thereof to said cylindrical storage tank structure and secured at a lower end thereof to said hull construction;

said cylindrical tank bottom plate having a peripheral portion thereof inclined with respect to a central portion thereof with said peripheral portion extending upwardly away from said bottom part of said hull construction and connected to a lower end of said cylindrical side plate;

said cylindrical side plate having an upper end thereof extending substantially above an upper deck surface of said vessel; and said cylindrical storage tank structure having a diameter equal to or greater than the height thereof.

2. The hull construction of a freight carrying vessel for storage and transportation of high and/or low temperature freight material as claimed in claim 1, wherein said central portion of said cylindrical bottom plate is flat.

3. The hull construction of a freight carrying vessel for storage and transportation of high and/or low temperature freight material as claimed in claim 2, further comprising tower structure means having an upper portion thereof secured to tank top plate means forming said upwardly-convex top surface of said cylindrical storage tank structure and a bottom portion thereof secured to said cylindrical tank bottom plate.

4. The hull construction of a freight carrying vessel for storage and transportation of high and/or low temperature freight material as claimed in claim 1, wherein said cylindrical tank bottom plate has a downwardly-convex shape and said tank bottom insulation means includes an upper surface in contact with said downwardly-convex shaped cylindrical tank bottom plate.

5. The hull construction of a freight carrying vessel for storage and transportation of high and/or low temperature freight material as claimed in claim 4, further comprising tower structure means having an upper portion thereof secured to tank top plate means forming said upwardly-convex top surface of said cylindrical storage tank structure and a bottom portion thereof secured to said cylindrical tank bottom plate.

6. The hull construction of a freight carrying vessel for storage and transportation of high and/or low temperature freight material as claimed in claim 1, further comprising tower structure means having an upper portion thereof secured to tank top plate means forming said upwardly-convex top surface of said cylindrical storage tank structure and a bottom portion thereof secured to said cylindrical tank bottom plate.

7. The hull construction of a freight carrying vessel for storage and transportation of high and/or low temperature freight material as claimed in claim 1, wherein said cylindrical tank bottom plate forms the bottom of said cylindrical storage tank structure, said cylindrical tank bottom plate having a downwardly-convex surface of sufficient strength to support said cylindrical storage tank structure in a no-load condition without any stiffener members being provided on said cylindrical tank bottom plate.

8. The hull construction of a freight carrying vessel for storage and transportation of high and/or low temperature freight material as claimed in claim 1, wherein four said cylindrical storage tank structures are provided along the longitudinal axis of said vessel.

9. The hull construction of a a freight carrying vessel for storage and transportation of high and/or low temperature freight material as claimed in claim 8, further comprising deep tank means disposed centrally along said longitudinal axis of said hull construction.

10. The hull construction of a freight carrying vessel for storage and transportation of high and/or low temperature freight material as claimed in claim 1, further comprising a tank weight support mount means for supporting said cylindrical storage tank structure, said tank weight support mount means being in contact with said tank bottom insulation means over an area, at a portion of said hull construction corresponding to at least the bow or stern of said vessel, which is substantially smaller than the area of said cylindrical storage tank structure in a horizontal plane passing through said cylindrical side plate, said tank skirt means being joined to said hull construction at a level higher than the level of said tank weight support mount means.

11. The hull construction of a freight carrying vessel for storage and transportation of high and/or low temperature freight material as claimed in claim 1, wherein the height of the portion of said cylindrical storage tank structure extending above said upper deck surface is about 40% of the overall height of said cylindrical storage tank structure.

12. The hull construction of a freight carrying vessel for storage and transportation of high and/or low temperature freight material as claimed in claim 1, wherein the height of said cylindrical side plate is about 60% of the overall height of said cylindrical storage tank structure.

* * * * *